US005143376A

United States Patent [19]

Johnson

[11] Patent Number: 5,143,376

[45] Date of Patent: Sep. 1, 1992

[54] GOLF CLUB SWINGING GUIDE

[76] Inventor: Knute Johnson, P.O. Box 7045, Victoria, British Columbia, Canada, V9B 4Z2

[21] Appl. No.: 774,881

[22] Filed: Oct. 11, 1991

[51] Int. Cl.[5] ..... A63B 69/36

[52] U.S. Cl. ..... 273/186.2; 273/194 R

[58] Field of Search ..... 273/192, 187 R, 186 A, 273/186 C, 186 D, 194 R, 194 A, 194 B, 193 B, 163 R, 163 A, 164, 162 F, 162 R, 34 R, 183 D; 446/243, 247, 265

[56] References Cited

U.S. PATENT DOCUMENTS

| | | | |
|---|---|---|---|
| 1,579,034 | 3/1926 | Roberts | 273/34 R X |
| 1,712,609 | 5/1929 | Gibson | 273/186 A |
| 1,966,895 | 7/1934 | Kuhns | 446/247 |
| 2,217,111 | 10/1940 | Gould | 446/247 |
| 2,652.251 | 9/1953 | Molinar | 273/187 R |
| 3,298,693 | 1/1967 | Eisenberg | 273/194 R X |
| 3,719,363 | 3/1973 | Harrison | 273/186 A |
| 3,844,569 | 10/1974 | Swanson | 273/192 |
| 4,576,378 | 3/1986 | Backus | 273/186 C X |

*Primary Examiner*—George J. marlo
*Attorney, Agent, or Firm*—Norman M. Cameron

[57] ABSTRACT

A golf club swinging guide is adapted for use on a golf club having a shaft and a head with a striking face. The guide includes a mount having a clamp for connecting the mount to a golf club generally above the head of the club. There is a vane pivotally connected to the mount. The vane is freely pivotal and responsive to movement of air so the vane visibly aligns itself in the direction the golf club is swung.

5 Claims, 4 Drawing Sheets

GOLF CLUB SWINGING GUIDE

BACKGROUND OF THE INVENTION

1. Description of Related Art

Initiate golfers frequently have difficulties swinging a golf club correctly so as to aim the ball toward the desired hole. The ball is correctly struck when the face of the head of the golf club is perpendicular to an imaginary straight line drawn from the golf ball to the hole. Rarely can a beginner swing the club so that it strikes the ball exactly perpendicular to this imaginary line.

If the face of the golf club head is not perpendicular to this line, the ball is deflected in a direction towards the golfer, known as "hooking", or in the direction away from the golfer, known as "slicing". Even relatively experienced golfers often have difficulty avoiding hooking or slicing.

Various aids have been developed in order to try to assist the golfer in swinging the club correctly so as to propel the ball in the direction of the hole. For example, U.S. Pat. No. 3,298,693 to Eisenberg shows a device with an arrow-shaped member which indicates the direction the club should be swung.

Vane-like members are shown in U.S. Pat. Nos. 3,719,363 and 3,758,117, both to Harrison. The fixed vanes are intended to cause the golfer to swing correctly.

U.S. Pat. No. 2,910,297 to Bonetate discloses the use of a series of propellers or spinners which are meant to show when the club is swung correctly. The patent indicates that the spinners rotate the fastest when the club is swung the correct way.

U.S. Pat. No. 3,687,549 to Swords shows a golf swing training device where markers are attached to the club to indicate defects in the swing.

A number of earlier patents disclose the use of a straight, elongated member attached to the club to indicate the correct direction of swing. The member is oriented perpendicular to the face of the head of the golf club. These include U.S. Pat. No. 4,953,867 to Rigsby, U.S. Pat. No. 4,789,158 to Chiesa, U.S. Pat. No. 4,002,343 to Eckert and U.S. Pat. No. 3,698,093 to Marshall. Other related United States patents include U.S. Pat. No. 3,262,705 to Nunziato, U.S. Pat. No. 2,670,209 to Fay, U.S. Pat. No. 3,529,830 to Palotsee as well as No. 188,677 to Thornson.

For one reason or another none of these prior art devices has become widely adopted. In some cases they appear to be relatively complex and difficult to use. In other cases, special golf clubs are required. Whatever the reason, the need remains for simple, inexpensive devices to help golfers swing a club correctly.

2. Summary of the Invention

One aspect of the invention overcomes problems associated with the related art by providing a golf club swinging guide having a mount and means for connecting the mount to a golf club generally above the head of the club. There is a vane pivotally connected to the mount so the vane visibly aligns itself with the direction the golf club is swung.

The guide may have a straight, elongated member connected to the mount so the elongated member extends perpendicular to the striking face of the head of the golf club. The vane aligns with the elongated member from the point of view of a golfer swinging the club when the club is swung perpendicular to the striking face.

Preferably, the vane and the elongated member have colors which contrast with each other.

Another aspect of the invention provides a golf club or putter swinging guide comprising a resilient clamp having a top and downwardly extending arms adapted to grip the sides of the head of a golf club. A straight, elongated member is connected to the clamp and is oriented to extend perpendicular to the striking face of the head.

A further aspect of the invention provides a golf tee guide comprising a first straight, elongated member having a golf tee extending perpendicularly therethrough. The member may point in the direction a golfer wishes to aim a golf ball. There may be a second straight, elongated member extending perpendicular to the first member and the tee, whereby by placing his or her feet astride the second member and parallel thereto, the golfer's feet are correctly positioned to swing a golf club.

DESCRIPTION OF THE PREFERRED EMBODIMENTS

Figure 1:
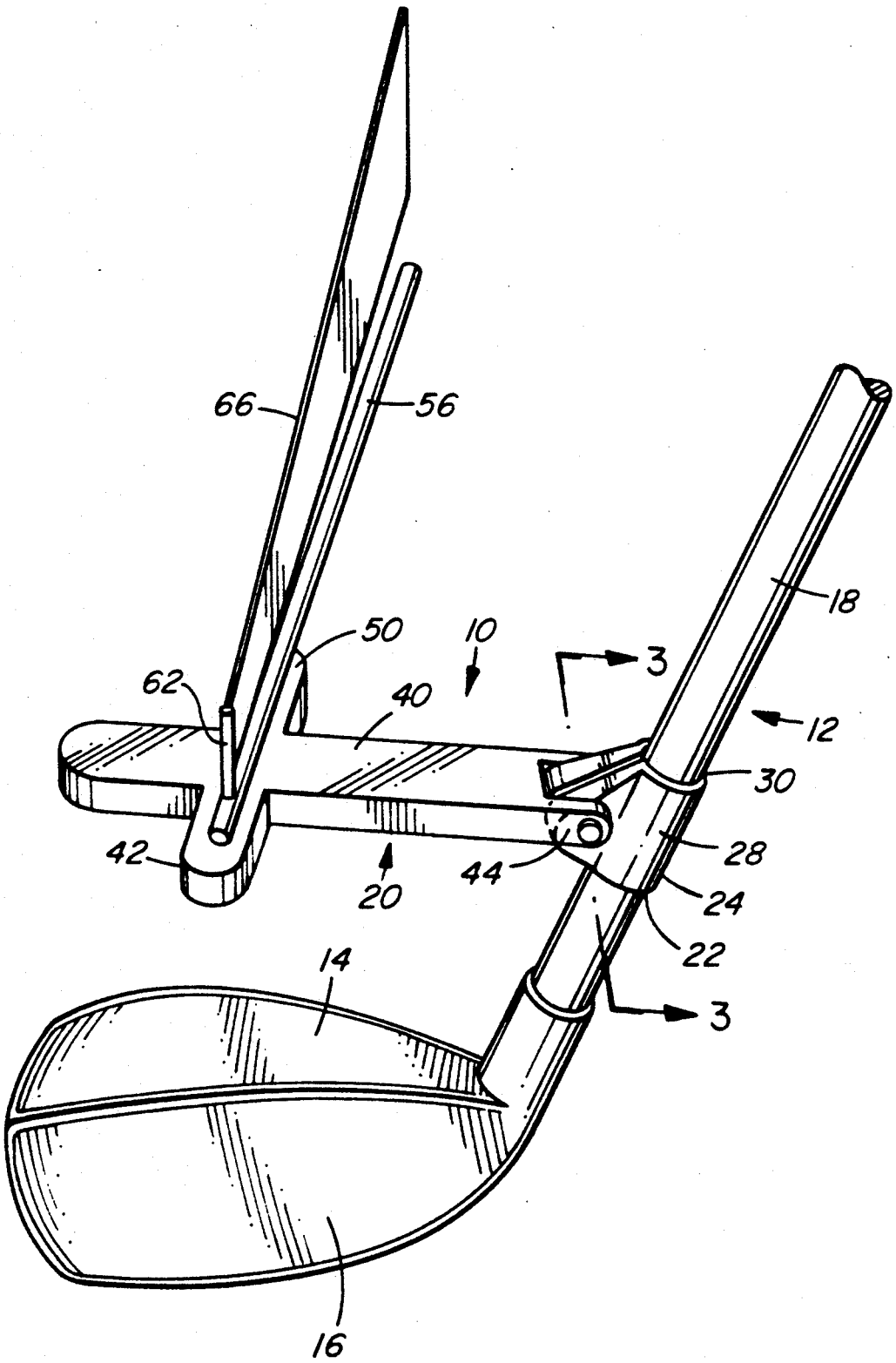
FIG. 1 is an isometric view of a golf club swinging guide according to a first embodiment of the invention mounted on a golf club which is shown in fragment.
Figure 2:
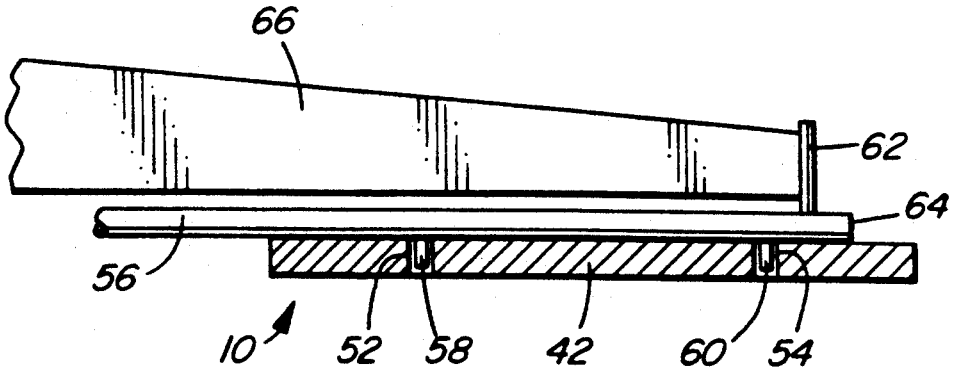
FIG. 2 is a side elevation of the vane and elongated member of the guide of FIG. 1, showing the mount therefor in section.
Figure 3:
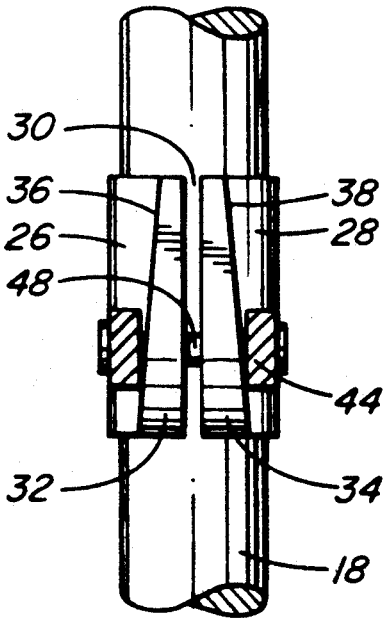
FIG. 3 is an enlarged sectional view taken along line 3—3 of FIG. 1.

FIG. 1-3 show a golf club swinging guide 10 connected to a golf club 12 which has a head 14 with a striking face 16 and a shaft 18 extending upwardly from the head. The guide 10 includes a mount 20 which in this embodiment is connected to shaft 18 of the club by a clamp 22. The clamp allows the guide to be easily and quickly mounted on any club. The clamp includes a tube-like portion 24 extending about the shaft. The tube-like portion has two separate halves 26 and 28 separated by a split 30 at the back of the club. The halves of tube-like portion 24 have generally parallel projections 32 and 34 which extend forwardly from shaft 18. As seen best in FIG. 3, these projections are generally trapezoidal in section, being thinner at their tops compared to the bottoms thereof. Thus their outer faces 36 and 38 taper toward the tops of the projections.

Mount 20 is generally T-shaped, having an arm 40 and a cross member 42. The rear portion of arm 40 is bifurcated to form a clevis 44. The clevis is received on each side of projections 32 and 34 of tube-like portion 24 and is pivotally connected thereto by means of a bolt 48 extending through corresponding apertures in the clevis and projections 32 and 34. Cross member 42 has a flat top 50 having a pair of spaced-apart apertures 52 and 54 shown in FIG. 2.

There is a straight, elongated member 56 having a pair of spaced-apart pins 58 and 60 received in apertures 52 and 54 of the cross member. In this embodiment member 56 is in the shape of a cylindrical rod, but other longitudinally straight members could be used instead. The pins on the member and the corresponding apertures in cross member 42 serve to connect member 56 to mount 20. The member 56 can be reversed for right or left handed golfers.

A pivot pin 62 is pivotally connected to member 56 adjacent its front 64. A vane 66 is connected to the pivot pin. The vane is generally trapezoidal in shape in this embodiment. In this example the vane is plastic, but metal or other materials could be used instead. Preferably the vane and member 56 have contrasting colors, for example green and red respectively.

In operation the golf club swinging guide 10 is connected to the club by first rotating arm 40 of mount 20 upwards about pivot pin 48 from the position shown in FIG. 1 and FIG. 3. This rotates clevis 44 to a position above the thinner tops of projections 32 and 34. This allows the halves 26 and 28 of tube-like portion 24 to move apart so that the tube-like portion can be fitted over shaft 18 of the club. After this is done, arm 40 is rotated downwards about pivot pin 48 to a position where cross member 42 is over head 14 of the club and the arm is parallel to the face 16 of the club. The longitudinal axis of member 56 is then perpendicular to striking face of the club. When the arm 40 is rotated downwards, this rotates the clevis 44 to the position shown in FIG. 3 where the clevis contacts the wider portions of projections 32 and 34, thus drawing the halves 26 and 28 of tube-like portion 24 together to secure the clamp 22 to shaft 18.

Once this has been done the golfer can swing the club to strike the ball in the conventional manner. Member 56 extends parallel to the correct direction of the swing. Vane 66 indicates the actual direction of swing and the direction of the face of the club because the vane is deflected by the movement of air relative to the vane as the club is swung. If the club is swung correctly, then the vane should extend along member 56 which can readily be seen by the golfer as he or she looks down on the guide. If the club is swung incorrectly, then the vane will be at an angular position relative to member 56 which can also be seen by the golfer. The contrasting colors of the vane and the member increase the visual affect. When the face of the club is not absolutely perpendicular to the desired direction of the swing, this will show immediately.

The exact shape and configuration of the guide as described is not critical. For example, different types of clamps can be used to secure the guide to the club. The mount can be integral with the club if desired and can extend upwardly from the head of the club instead of being connected to the shaft. The vane can be in the form of a rod with a fin on the end. The vane and member 56 can extend on both sides of the pivot instead of just rearwardly from the pivot as illustrated.

Figure 4:
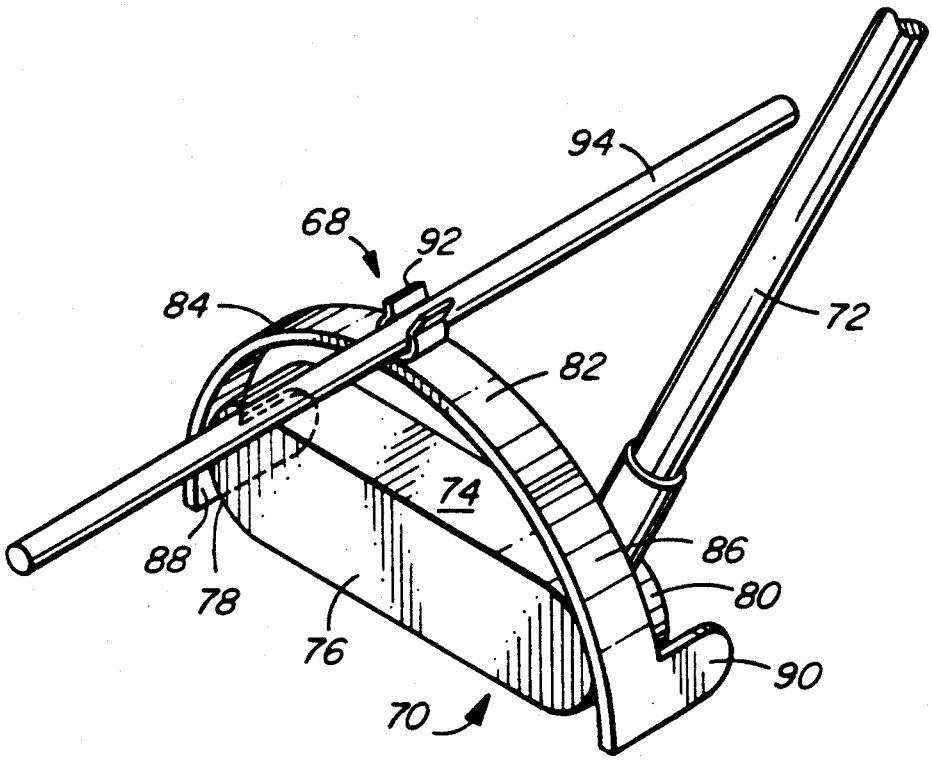
FIG. 4 is an isometric view of a putter swinging guide according to a second embodiment of the invention, mounted on a putter which is shown in fragment.

A second embodiment of the invention is shown in FIG. 4. Golf club or putter swinging guide 68 of this embodiment is primarily intended for use on a putter, such as putter 70 as illustrated. Putter 70 has a shaft 72 and a head 74 with a striking face 76 and sides 78 and 80. The guide 68 includes a resilient clamp 82 having downwardly extending arms 84 and 86 on each side thereof. The arms have projections 88 and 90 extending perpendicularly from the bottoms thereof. These projections grip the sides of the head of the club as shown in the drawing. There is a clip 92 connected to the top of the clamp and configured to receive a rod 94 which extends perpendicular to the striking face 76 of the club when the guide is correctly positioned thereon.

In use, clamp 82 is clamped onto the putter with the sides of arms 84 and 86 parallel with the face 76 thereof. Rod 94 is thus perpendicular to face 76. The rod 94 is pointed in the direction the golfer wants to drive the ball. It is particularly intended for putters used when the distance to the golf hole is relatively small, but the guide can also be used on other clubs as well. The projections 88 and 90 are intended to provide clearance for shaft 72 of the club when the shaft is not offset relative to the head of the putter. However, in many putters the shaft is offset away from the striking face 76 of the club. Thus the projections 88 and 90 could be omitted for such putters.

Figure 5:
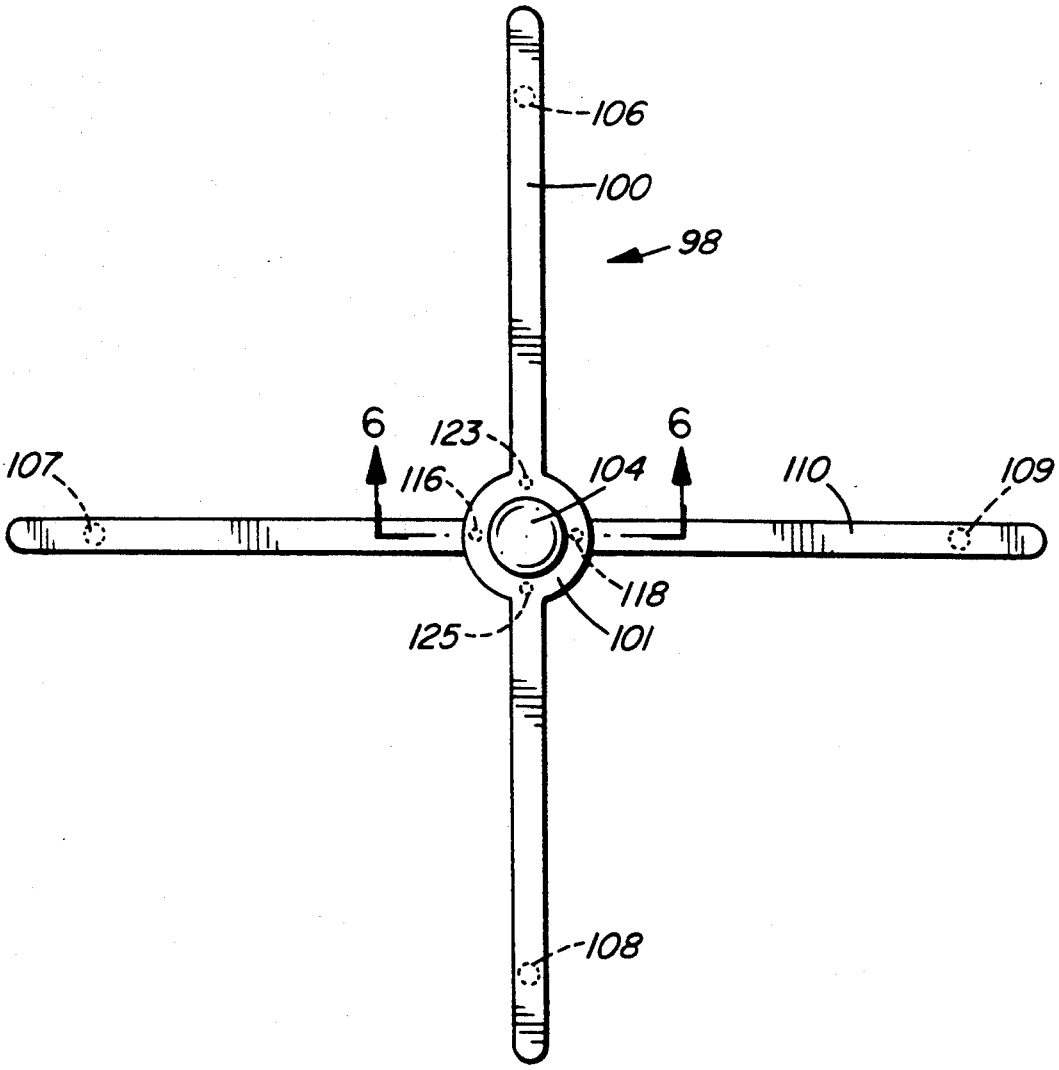
FIG. 5 is a top plan view of a golf tee guide according to a third embodiment of the invention.
Figure 6:
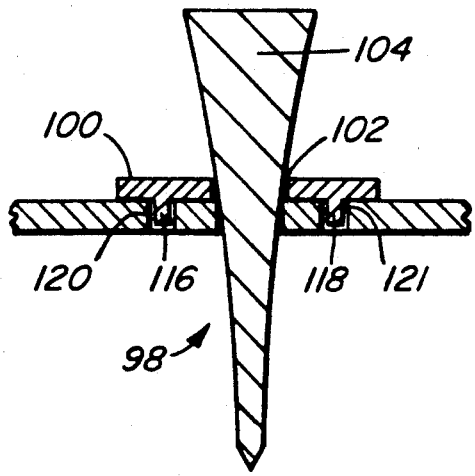
FIG. 6 is an enlarged sectional view taken along line 6—6 of FIG. 5.

A third embodiment of the invention is shown in FIG. 5 and 6. The golf tee guide 98 in this embodiment is in a form of straight, elongated member 100 having a ring-like portion 101 at the center thereof having an aperture 102 therethrough for receiving a golf tee 104. The member also has downwardly extending pins 106 and 108 intended to be pushed into the ground to secure the member in place.

In this embodiment there is also a second straight, elongated member 110 which is generally similar to member 100 and is pivotally connected to the first member by means of pins 116 and 118 of member 100 which fit tightly within apertures 120 and 121 of member 110. Likewise member 100 has apertures 123 and 125 which are 90° from pins 116 and 118 and receive pins on member 110.

In operation, member 100 is aligned in the direction the golfer wants to hit the ball sitting on tee 104. The golfer aligns his feet with member 110 which serves to indicate the correct position for his or her feet. The golfer then swings the club along the direction of member 100 to accurately hit the ball.

The three embodiments described above can be used together to help improve a golfer's game or each can be used alone without reference to the other guides. When used together, the member 56 and vane 66 of guide 10 and member 100 of guide 98 all line up when the club is swung correctly.

It will be understood by someone skilled in the art that many of the features described above are by way of example only and can be changed without departing from the scope of the invention which is to be interpreted with reference to the following claims.

What is claimed is:

1. A golf club swinging guide for a golf club having a shaft and a head with a striking face, the guide comprising:

a mount having means for connecting the mount to a golf club generally above the head of the club; and a vane pivotally connected to the mount, the vane being freely pivotal and responsive to movement of air so the vane visibly aligns itself in a direction the golf club is swung.

2. A guide as claimed in claim 1, having a straight, elongated member connected to the mount so the elongated member may be oriented perpendicular to the striking face of the head of the club.

3. A guide as claimed in claim 2, wherein the vane aligns with the elongated member from the point of view of a golfer swinging the club when the club is swung in a direction perpendicular to the striking face.

4. A guide as claimed in claim 3, wherein the vane and the elongated member have different, contrasting colors.

5. A guide as claimed in claim 1, wherein the means for connecting is a clamp with a recess for receiving the shaft of the club.

* * * * *